United States Patent [19]

Read et al.

[11] Patent Number: 4,671,739

[45] Date of Patent: Jun. 9, 1987

[54] ONE PIECE MOLDED FAN

[75] Inventors: Robert W. Read, 5405 104th St., SW., Tacoma, Wash. 98499; Edmund A. Gress, deceased, late of Tacoma, Wash., Olive M. Gress, executrix

[73] Assignee: Robert W. Read, Tacoma, Wash.

[21] Appl. No.: 167,474

[22] Filed: Jul. 11, 1980 (Under 37 CFR 1.47)

[51] Int. Cl.[4] ..... F04D 21/32

[52] U.S. Cl. ..... 416/230; 416/234; 416/241.4

[58] Field of Search ..... 416/223 R, 230, 241 A, 416/234, 243, 132 B, 132 A; D23/165

[56] References Cited

U.S. PATENT DOCUMENTS

| | | | |
|---|---|---|---|
| D. 225,530 | 12/1972 | Pommert | D23/165 |
| D. 246,725 | 12/1977 | Bonifant | D23/165 |
| D. 246,795 | 12/1977 | Bonifant | D23/165 |
| 1,905,891 | 4/1933 | Blanchard | 416/234 |
| 3,260,312 | 7/1966 | Elmer | 170/160.5 |
| 3,336,010 | 8/1967 | Conn | 416/234 |
| 3,751,181 | 8/1973 | Hayashi | 416/132 |
| 3,758,231 | 9/1973 | Barnstead | 416/132 |
| 3,822,103 | 7/1974 | Hori et al. | 416/132 |
| 3,825,369 | 7/1974 | Albertzart | 416/229 |
| 3,951,611 | 4/1976 | Morrill | 416/223 R |
| 4,046,489 | 9/1977 | Fairchild et al. | 416/223 R |
| 4,142,844 | 3/1979 | Brattstrom | 416/223 R |
| 4,187,055 | 2/1980 | Barnstead | 416/132 |

*Primary Examiner*—Louis J. Casaregola
*Attorney, Agent, or Firm*—Gregory W. Moravan

[57] ABSTRACT

A one piece, fiber reinforced, plastic radiator cooling fan for a truck. The fan is reinforced by: a hub extension which extends from the hub into each blade a substantial distance; by directly interconnecting the leading and trailing edges of adjacent blades to form a juncture therebetween in the form of a spiral located radially outwardly from the hub; by having the leading and trailing edges of adjacent hub extensions interconnect in a smoothly curved line tangent to the hub; by strengthening locations of high stress in each blade; and by avoiding sudden changes in thickness and in direction of the various portions of the fan.

21 Claims, 30 Drawing Figures

FIG. 8
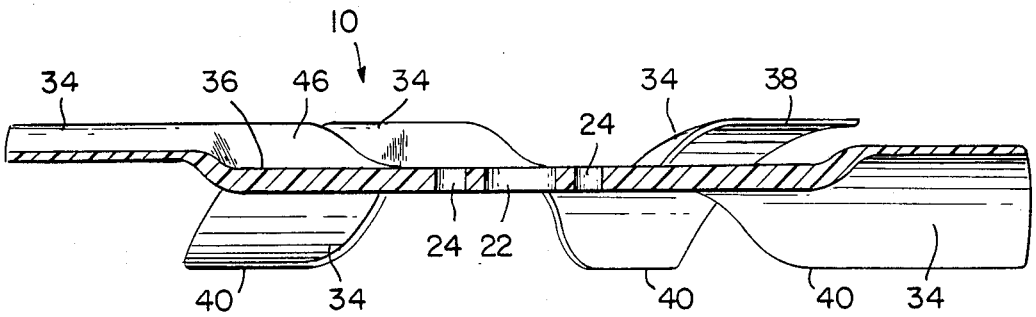
FIG. 9
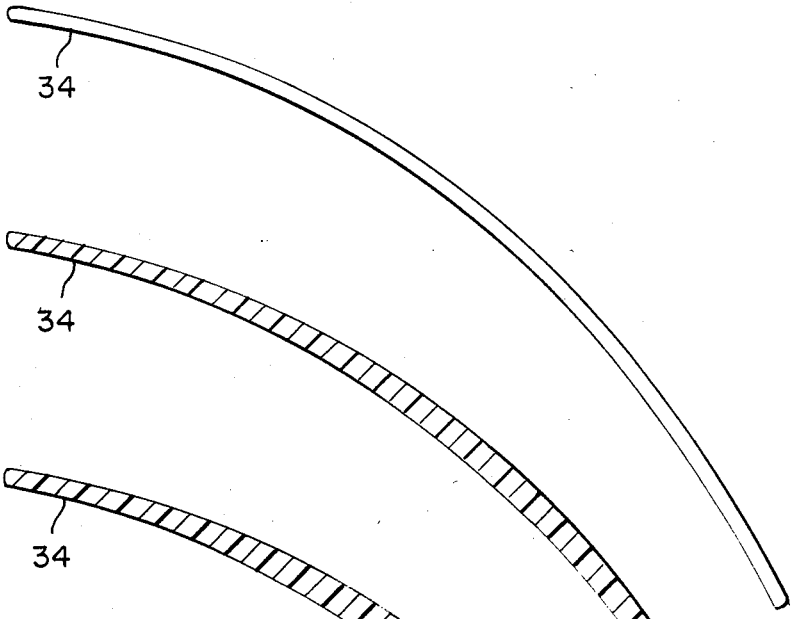
FIG. 10
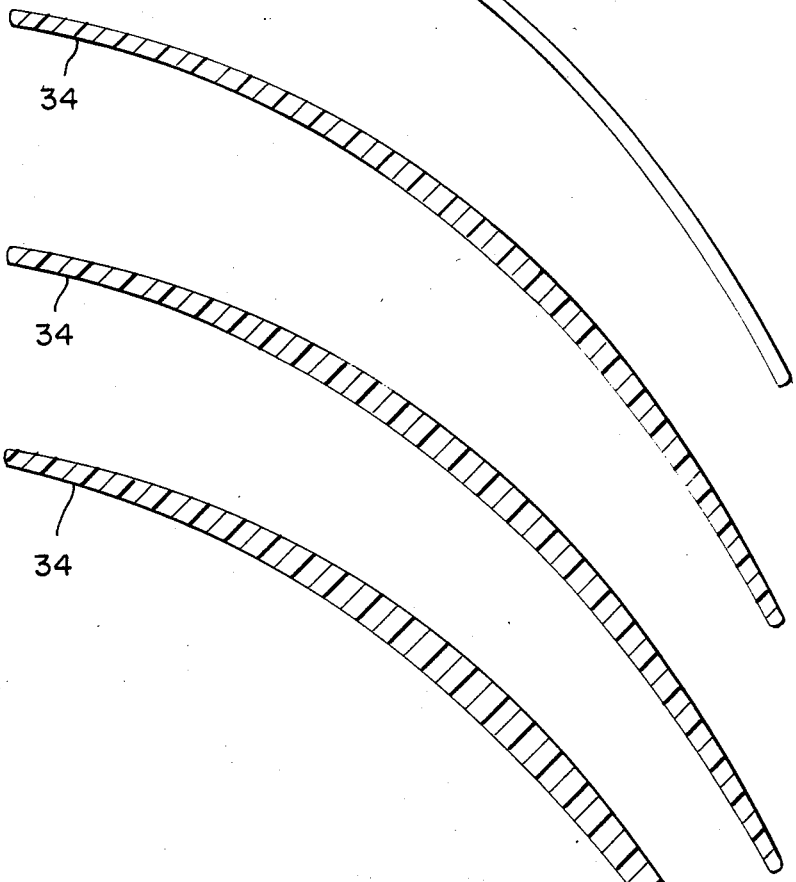
FIG. 11
FIG. 12
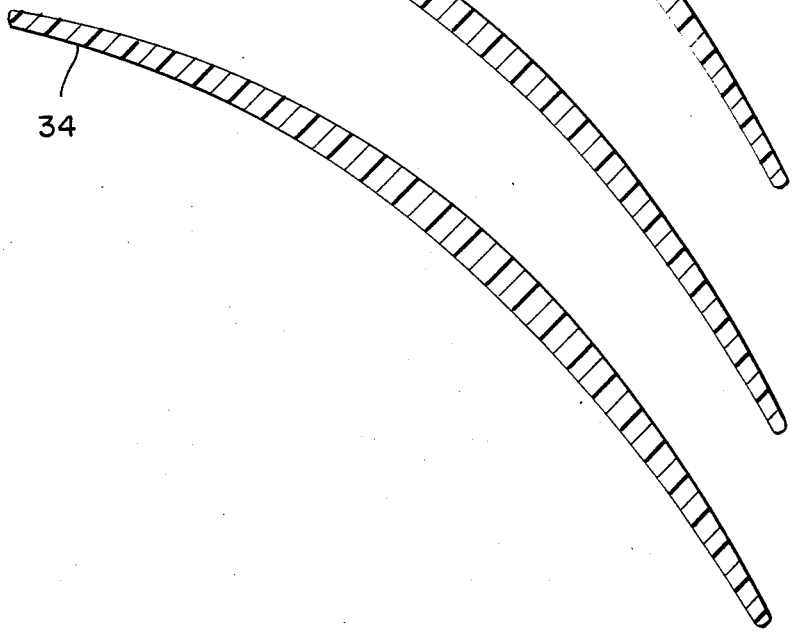

FIG. 13
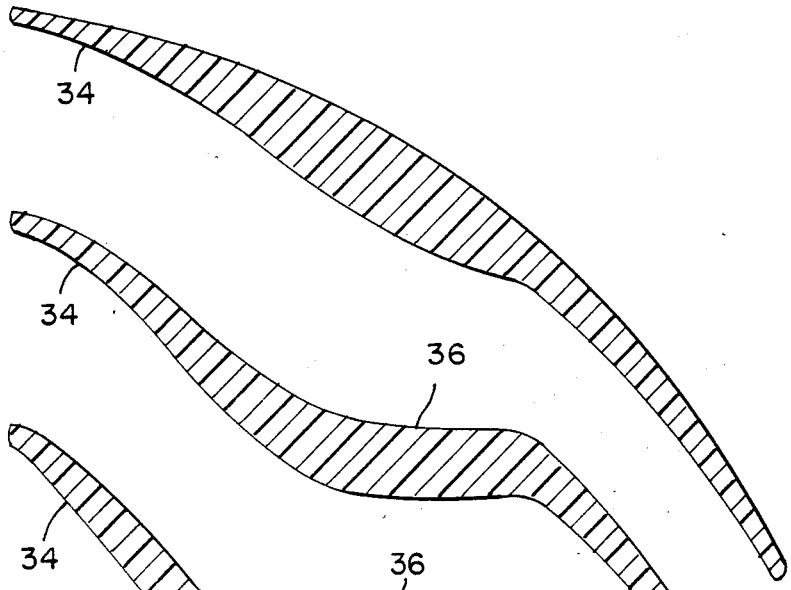
FIG. 14
FIG. 15
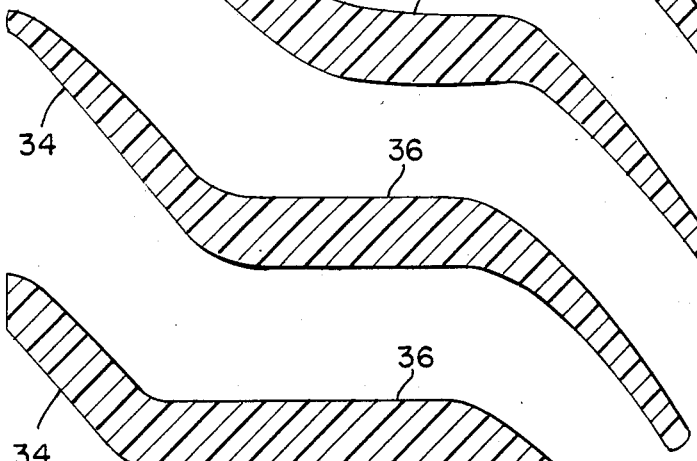
FIG. 16
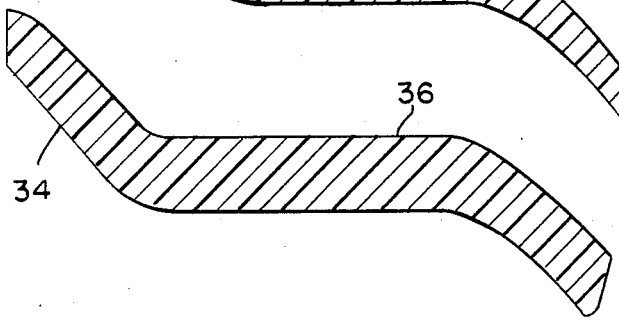
FIG. 17
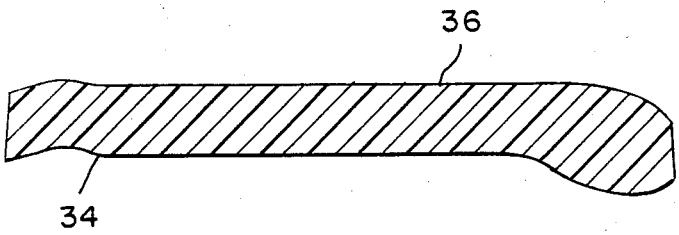

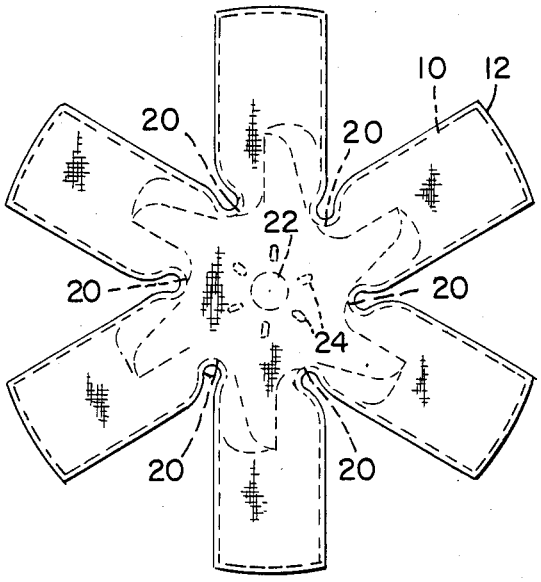
FIG. 18
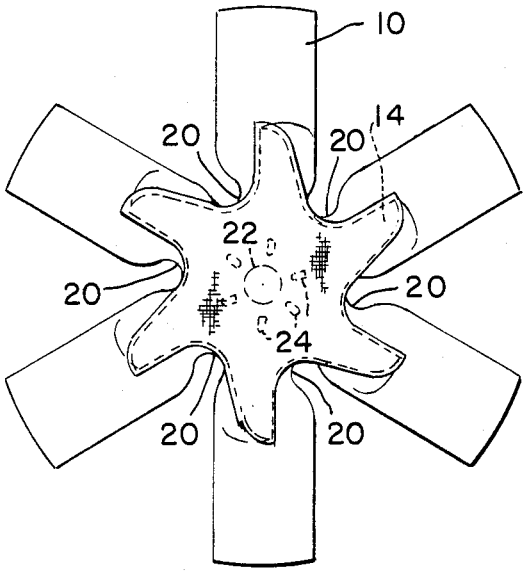
FIG. 19
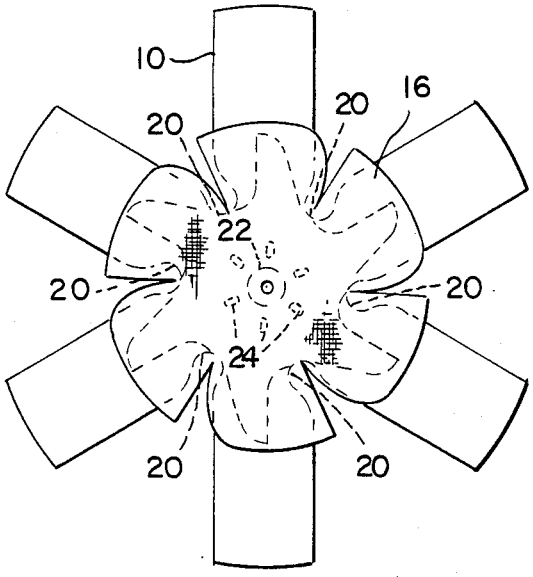
FIG. 20
FIG. 21
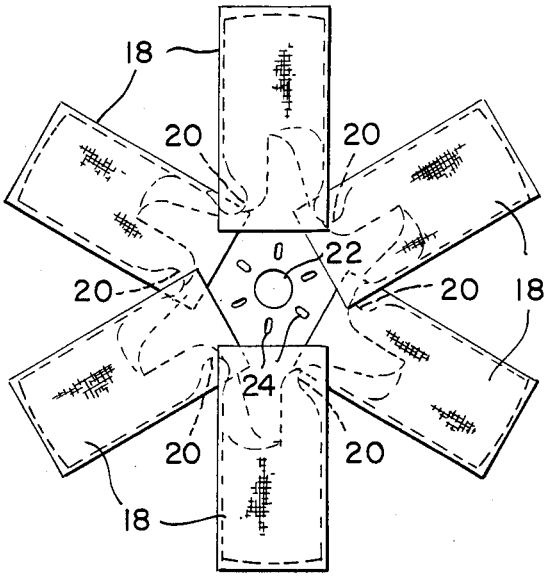

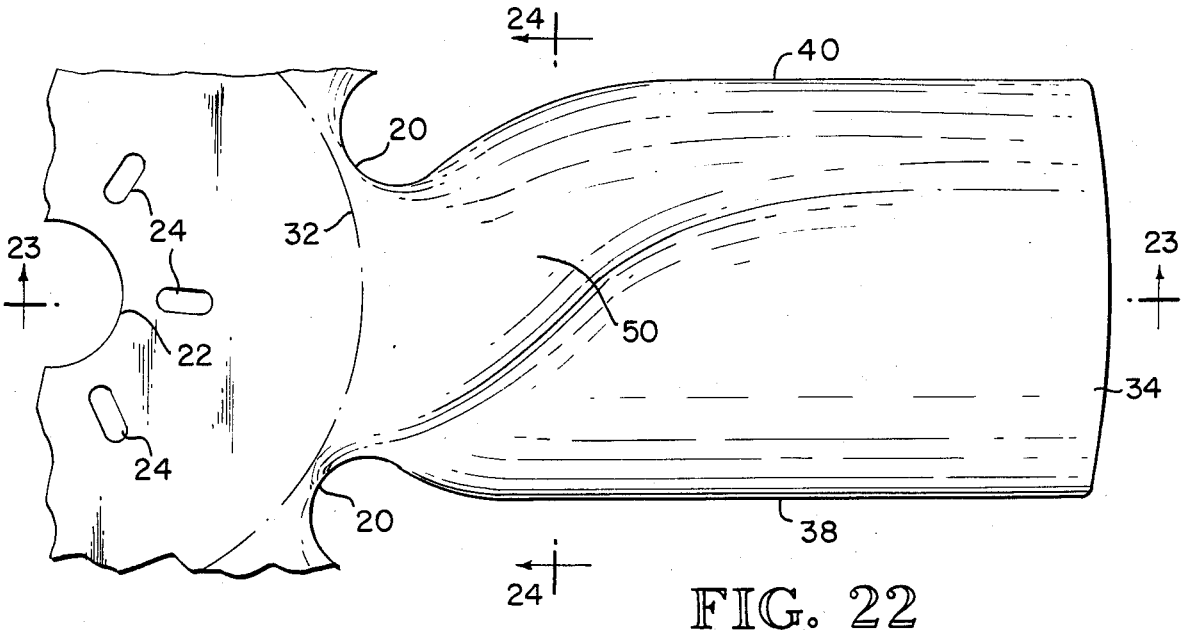
FIG. 22
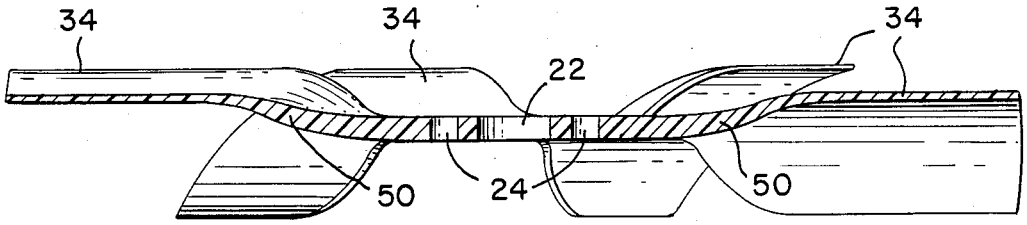
FIG. 23
FIG. 24
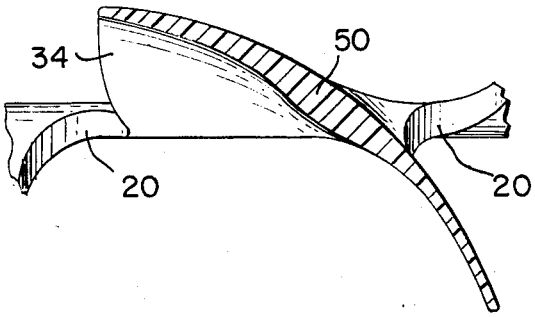

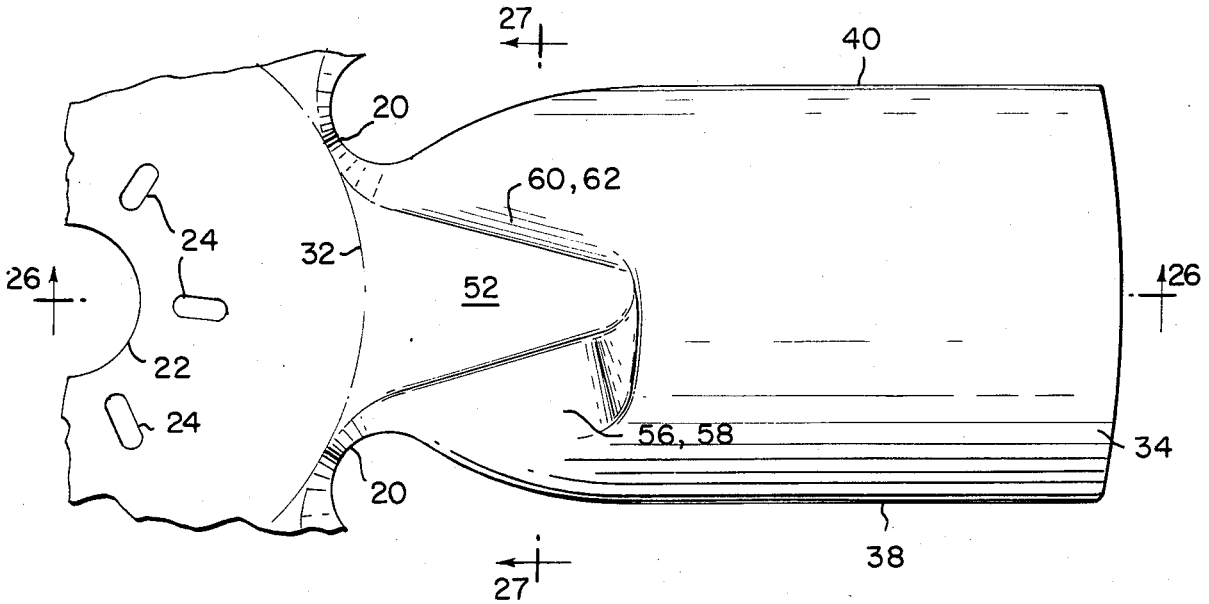
FIG. 25
FIG. 26
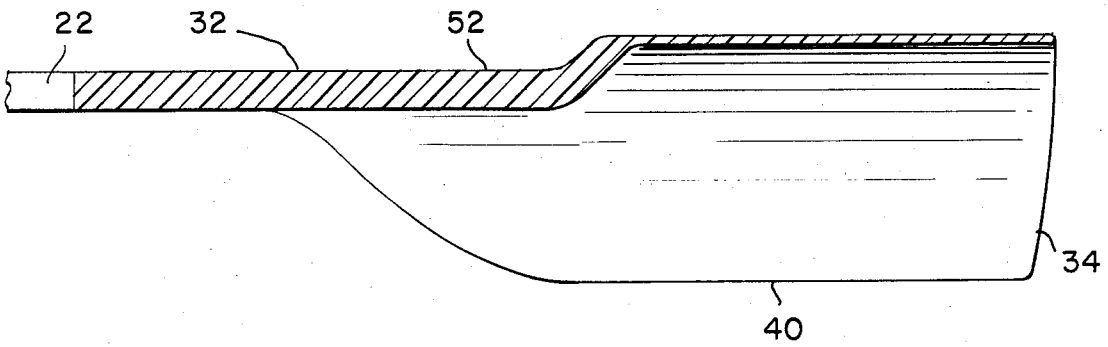
FIG. 27
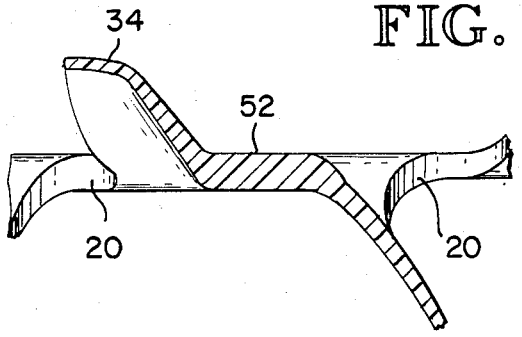

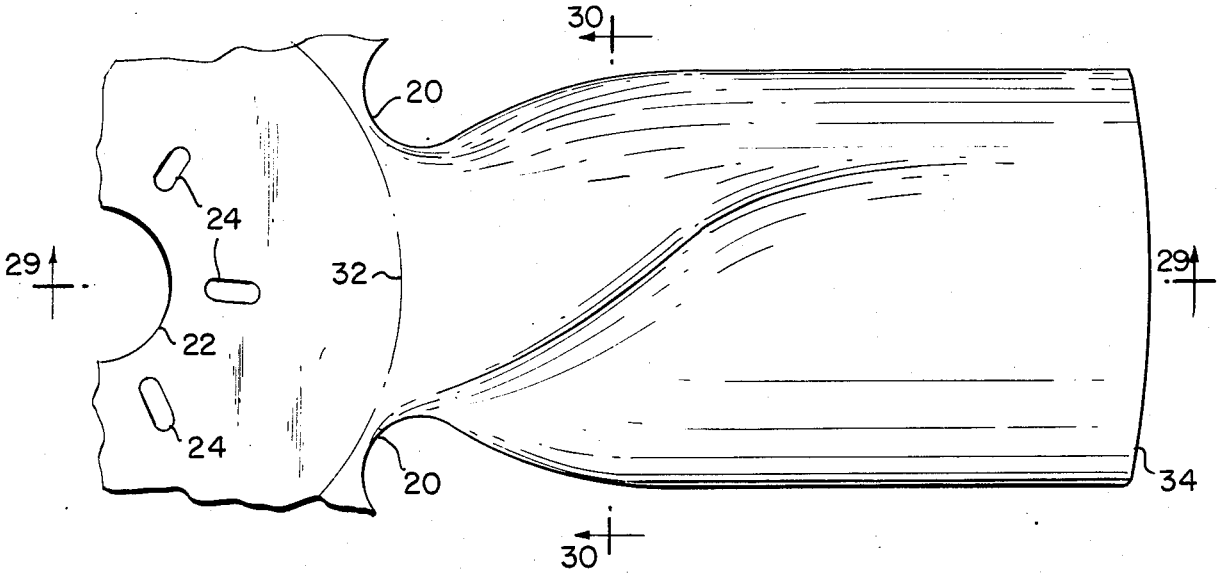
FIG. 28
FIG. 29
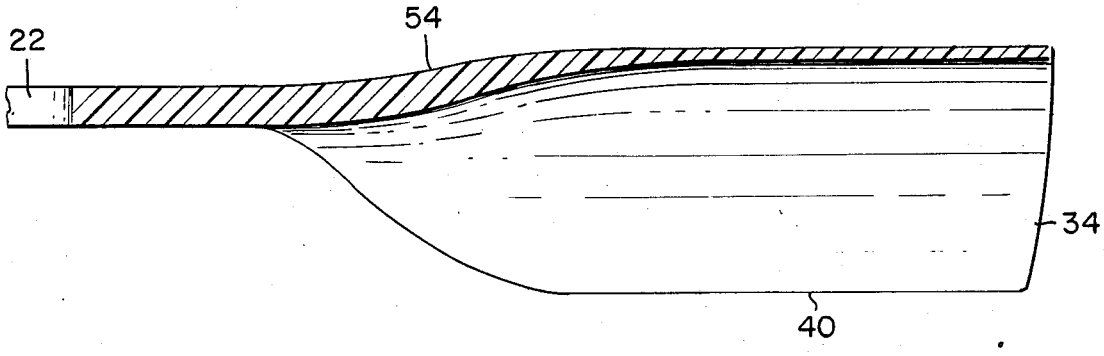
FIG. 30
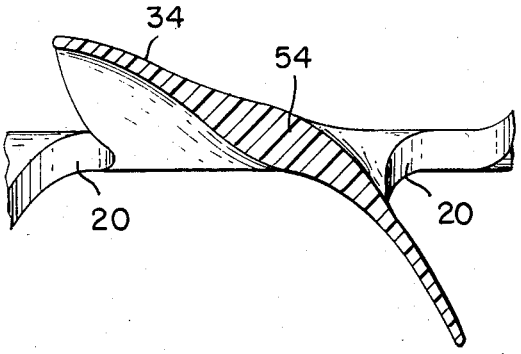

ONE PIECE MOLDED FAN

SUMMARY OF THE INVENTION

As is known, there are many different stresses imposed on any radiator fan. If the fan is unable to withstand any of these stresses, fatigue cracking of the fan will occur resulting in its eventual failure, and often catastrophic destruction due to its high operating rpm. To make matters worse, frequently these stresses act in concert, making it that much more difficult for the radiator fan to survive them. In order to better appreciate the ingenuity of the fan of the present invention, consideration should be given to the kinds of stresses to which any fan is subjected during its operating life.

The first type of stress on a fan is centrifugal stress which tends to cause radial separation of the blades from the hub due to the "centrifugal weight" of the blades. The centrifugal stress on a fan changes each time the fan's rpm changes; increasing as the rpm increases, and decreasing as the rpm decreases.

The second type of stress is lift stress caused by the aerodynamics of the fan blades as they rotate through the air. Lift stress causes each blade to tend to bend slightly so as to tend to rise above the hub a little more as the fan's rpm increases, with the blades gradually resuming their original orientation as the fan slows to a stop. Naturally, each time the fan's rpm changes the lift stress imposed on the fan changes.

The third type of stress is reactive stress caused by the fan blades thrusting air rearwardly behind them. Reactive stress affects the fan in the same way as does lift stress.

The fourth type of stress is flutter stress and is related to lift stress and reactive stress. Flutter stress is caused by obstructions in the fan's air intake or slipstream. For example, a typical cause of flutter stress are the radiator covers frequently used by truckers in the winter to prevent overcooling of their engines, which covers usually expose only a small portion of the radiator to the air. As will be appreciated, the lift and reactive stresses on each blade greatly increase as the blade passes the opening in the radiator cover and is exposed to the air and are greatly reduced as the blade passes behind the rest of the radiator cover. Flutter stress is particularly hard on a fan because each blade is stressed and unstressed each time it makes one revolution, meaning it can be stressed and unstressed thousands of times a minute, depending on the fan's rpm. Flutter stress can also be caused by obstructions in the fan's slipstream, such as by the truck's generator, hoses, belts, etc.

The fifth type of stress is twist stress which causes each fan blade to twist about its longitudinal axis. Twist stress is caused primarily by centrifugal force which, as is known, tends to make any spinning object assume a disc-like configuration. Thus, the twist stress on the blades of the fan tends to twist the blades so they tend to become coplanar with the hub. As will be appreciated, twist stress causes the fan's blades to twist more and more as the fan is spun faster and faster; and then, of course, the blades will untwist in the opposite direction to assume their original configuration as the fan is spun slower and slower. Each time the fan's rpm changes, the blades will correspondingly twist or untwist a little.

The sixth type of stress is inertial stress and occurs as the fan's rpm is accelerated and deaccelerated. Inertial stress tends to cause each fan blade to fold to assume a position wherein it is adjacent the periphery of the hub.

As the fan is accelerated, each blade tends to fold in one direction, and as the fan is deaccelerated, each blade tends to fold in the opposite direction. The faster the acceleration or deacceleration, the greater the inertial stress on the fan; and each time the fan is accelerated or deaccelerated it is subjected to a changing inertial stress.

The seventh type of stress is harmonic or noise stress, wherein the resonant vibrations in the fan caused by noise and by any of the stresses discussed above can set up harmful standing waves in the fan.

It will be appreciated that all of these various types of stresses are inflicted on a radiator fan each time it is run, and, as has been mentioned, at certain times all of these types of stresses are inflicted on the fan simultaneously. Even worse, all of these types of stresses are primarily concentrated in the connections between the blades and the hub, and in the connections between adjacent blades. As is known, the repeated stressing and unstressing of a fan can eventually lead to its fatigue cracking, and even to its eventual failure and destruction, particularly when the stresses are concentrated in the same locations.

Radiator fans are used in a variety of environments. Some environments are relatively undemanding, such as when the fan is used in a fixed base gasoline or diesel engine driven electrical gemerating facility where the fan is run at a constant speed in a fixed location, and where the air flows into and out of the fan are relatively uniform. In such an environment even a weak fan may survive since it is subjected to relatively little flutter stress, inertial stress and harmonic stress; and the stresses to which it is subjected are relatively constant, meaning the fan is not being constantly worked through numerous stress cycles.

On the other hand, some environments are much harder on a radiator fan, and a truck environment is particularly hard on a fan because of several factors. The first factor is the large physical size of a truck fan, typically 28 inches in diameter and having ten inch long blades. The longer the blades are of course, the more the forces acting on the blades tend to be multiplied as they stress the interconnection between adjacent blades.

Second, as has been noted, all of the seven kinds of stresses discussed above increase as the fan's rpm increases and decrease as the fan's rpm decreases. Since the rpm of the truck's engine (and fan) are almost constantly changing, the amount of the stresses which are imposed on the fan are also constantly changing, meaning that the blades on the fan are constantly moving or working small amounts with respect to the hub and with respect to each other as the stresses change. The more cycles of movement, the more likely that a stress failure will occur.

Third, when used on a truck, the fan frequently encounters large amounts of stress and quick changes in the amount of stress, both of which can contribute to the failure of the fan. For example, when a truck accelerates between two gears, the engine (and fan) are driven to a high rpm. Then, when the driver hits the clutch and drops the engine into the next higher gear, the engine and fan rpm will drop several thousand rpm in just a second or two, resulting in large, sudden changes in all seven of the stresses discussed. Even worse, this stress cycle is repeated every time the driver shifts gears.

Further, the stresses to which a truck fan is subjected are greatly aggravated by the current trend towards the increased use of radiator fan clutches in trucks which disengage the fan from the engine when the ram air into the radiator from the truck's motion provides sufficient cooling air to the radiator, and engages the fan with the engine when the ram air alone provides insufficient cooling. Fan clutches are increasingly popular because disengaging the fan when it is not needed saves fuel and also reduces the noise produced by the truck. The need for fuel conservation is apparent, while reduction in the noise produced by the truck will become increasingly important as governmental regulations on noise pollution become increasingly stringent.

It should be noted that most fan clutches impose enormous stresses on the fan as it engages. This is because typically, most fan clutches engage quite suddenly, in order to lengthen the life of the friction materials in the clutch. As a result, when the fan clutch engages, the fan is accelerated from a zero or a very low rpm to a very high, operating rpm is just a fraction of a second. This sudden, repeated change from almost zero stress on the fan to a maximum amount of each of the seven stresses discussed above, can eventually cause stress cracking and failure of the fan.

Conventional metal radiator fans which can withstand these stresses have three main drawbacks. They are heavy, costly, and relatively inefficient. They are heavy because they are usually made from steel. They are costly because expensive, heavy machinery and dies are required to stamp their component parts from sheet metal, which then leaves large amounts of scrap metal to be disposed of. In addition, the component parts must be assembled, as by welding or riveting, which is another costly process. Finally, they are relatively inefficient because assembled metal fans are relatively dirty in an aerodynamic sense due to protuding welds or rivets and due to a lack of smooth contours between adjacent parts.

On the other hand, fiber reinforced plastic fans combine strength with lightness, since both plastic and nonmetallic reinforcing fibers such as fiberglass are much lighter than steel. In addition, manufacturing costs are lowered, since the fan is molded in one piece. Finally, since there are no welds or rivets on a one piece molded fan and since all the contours can be molded as smoothly rounded as desired, the fan's efficiency is superior.

Accordingly, the primary objects of the present invention are to provide a one piece, fiber reinforced plastic truck fan which will successfully withstand all of the stresses discussed above, and which will do so at a lower weight, a lower cost and at a higher air moving efficiency than conventional metal truck fans. Of course, such a fan which can withstand a truck environment will withstand the stresses imposed in less demanding, non-truck environments exceptionally well.

These objects are at least partially achieved by the following features of the present invention, all of which preferably act in cooperation to provide the desired result.

Perhaps the most notable feature of the present invention is the hub extension provided for each blade. Each hub extension is substantially as thick as the hub, extends into its respective blade a substantial distance, and tapers in width as it travels out into the blade. The hub extensions are intended to stiffen and reinforce both the blades and their connections with the hub. Each hub extension's leading and trailing edges preferably merge into the hub at a tangent with respect thereto for increased strength and to help prevent undesireable stress concentrations.

In addition, the fan's strength is increased and stress concentrations are reduced by avoiding sudden changes in the thickness and direction of the fan's parts. This means the fan gradually tapers in thickness from the hub and hub extensions to the blades, and that all curves in the blades and hub extensions are gently rounded.

Another feature of the fan of the present invention is that the leading and trailing edges of adjacent blades are connected directly to each other to provide mutual reinforcement. Preferably, the interconnections between adjacent blades are located radially outwardly from the hub, and are located between the hub extensions so as not to weaken nor disturb the hub or the hub extensions, and to help to prevent undesireable stress concentrations between adjacent blades.

Further, each interconnection between the leading and trailing edges of a pair of adjacent blades is smoothly rounded in the shape of a spiral for strength and to help prevent undesireable stress concentration therebetween.

It is to be understood that the forgoing is but a brief summary, not a detailed catalog, of some of the objects and features of the present invention, and is not to be taken as a limitation on the scope of the present invention. The scope of the invention is to be construed to include all of the features and benefits inherent in the disclosed invention, whether or not specifically mentioned anywhere herein.

BRIEF DESCRIPTION OF THE FIGURES

FIG. 8 is a cross sectional view of the fan taken along line 8—8 of FIG. 3, on a ¼ scale;

FIG. 9 is a side elevational view of the end of one blade of the fan taken along line 9—9 of FIG. 3 on a full scale, with the background ommitted for clarity;

FIGS. 10–17 are cross sectional views of one blade of the fan taken along lines 10—10 to 17–17 of FIG. 3, on a full scale, with the background omitted for clarity;

FIG. 18 is an elevational view of one of the fiber reinforcing mats used in the fan, the fan being shown in phantom;

FIG. 19 is an elevational view of another of the fiber reinforcing mats used in the fan, the mat being shown in dotted outline;

FIG. 20 is an elevational view of another of the fiber reinforcing mats used in the fan, portions of the fan being shown in phantom;

FIG. 21 is an elevational view of another of the fiber reinforcing mats used in the fan, six being illustrated, with portions of the fan shown in phantom;

FIG. 22 is an elevational view of a portion of the front of a second emboidiment of the fan of the present invention, on a ½ scale;

FIG. 23 is a longitudinal cross section of the fan of FIG. 22 on a ¼ scale, taken along line 22—22 thereof;

FIG. 24 is a transverse cross section of the fan of FIG. 23, taken along line 24—24 thereof, on a one-half scale;

FIG. 25 is an elevational view of the front of a third embodiment of the fan of the present invention on a ½ scale;

FIG. 26 is a longitudinal cross section of the fan of FIG. 25 on a ½ scale, taken along line 26—26 thereof;

FIG. 27 is a transverse cross section of the fan of FIG. 27, taken along line 27—27 thereof, on a one-half scale;

FIG. 28 is an elevational view of the front of a fourth embodiment of the present invention, on a ½ scale;

FIG. 29 is a longitudinal cross section of the fan of FIG. 28 on a ½ scale, taken along line 29—29 thereof; and FIG. 30 is a transverse cross section of the fan of FIG. 28. taken along line 30—30 thereof, on a one-half scale.

DESCRIPTION OF THE PREFERRED EMBODIMENTS

Figure 1:
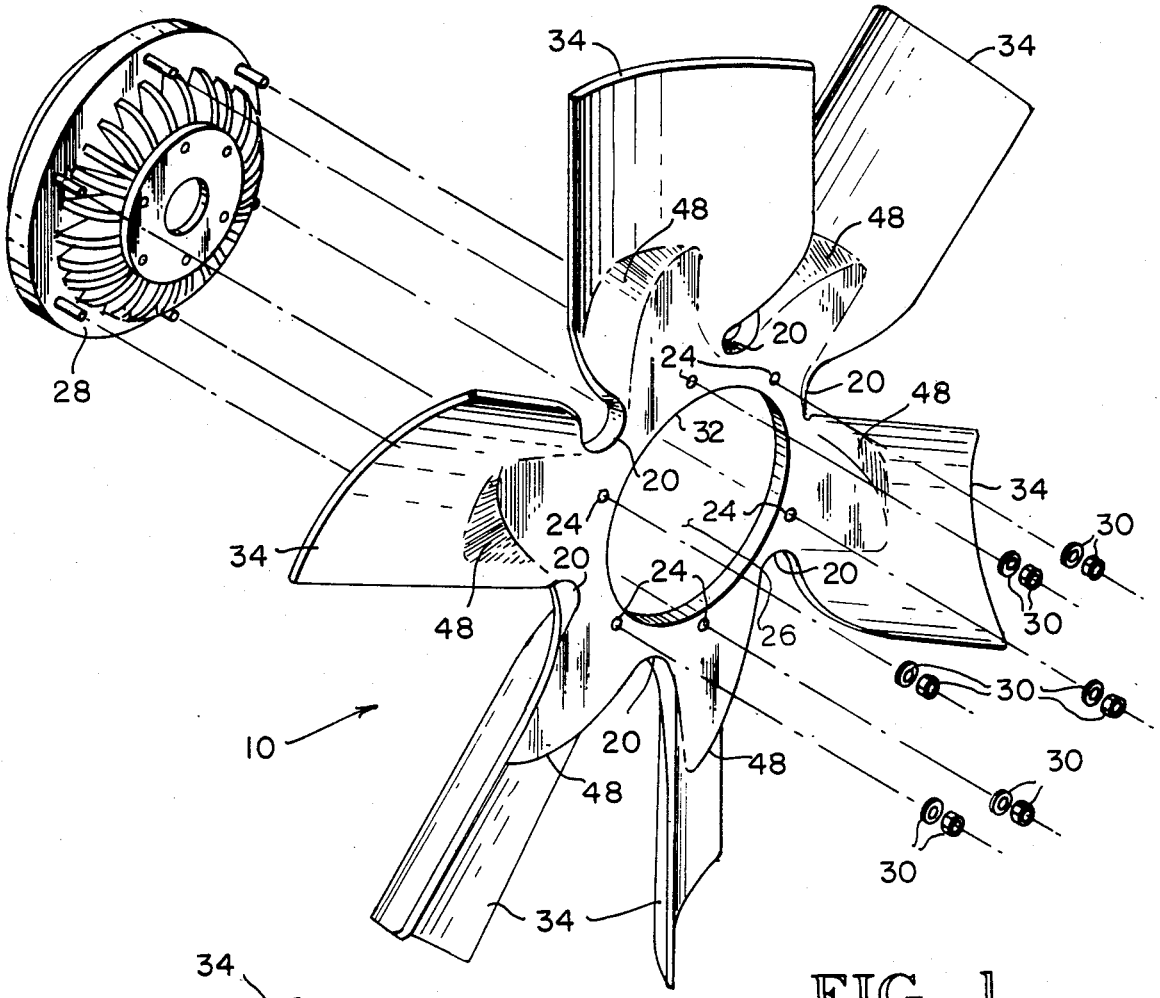
FIG. 1 is a perspective view of the rear of the fan of the present invention having an enlarged central hole and showing its manner of attachment to a viscous type fan clutch.

Referring now to the figures, a description will first be given of the manner of fabricating the fan of the present invention, and then a detailed consideration of its features will be addressed.

The fan of the present invention can be conveniently molded by any suitable conventional molding technique. However, the technique presently used by applicant is to first precut the fiberglass reinforcing mats used in the fan 10. The fiberglass reinforcing mats shown in FIGS. 18–20 are cut from two ounce per square foot fiberglass mat, such as type M8610 continuous strand mat produced by the Owens-Corning Company of Granville, Ohio. The reinforcing mat shown in FIG. 21, is a 24 ounce per square foot, woven fiberglass mat type, such as that produced by the Owens-Corning Company of Granville, Ohio. It is preferred that fiberglass fibers be used as the reinforcing material in the fan due to their relatively low cost and relatively high strength. Naturally, a variety of other metallic and nonmetallic reinforcing fibers could be used such as carbon fibers, aramid fibers or any othr suitable material.

Next, the male and female molds, not illustrated, are coated with any conventional release agent to prevent adhesion to the mold of the resin used in the fan. Then, the fiberglass reinforcing mats are placed in the female mold in the following order. One mat 12 (FIG. 18), two mats 14 (FIG. 19), one mat 16 (FIG. 20), two mats 14 (FIG. 19), one mat 16 (FIG. 20), one mat 18 per blade (FIG. 21), one mat 14 (FIG. 19), and one mat 17 (FIG. 18).

Then the male mold is lowered into the cavity of the female mold to compress and hold the fiberglass mats in place between the two molds. Next, the plastic resin is injected into the middle of the mold cavity through a ½ inch tube under a pressure of about twenty psi, and any suitable means are used to hold the mold halves together with a pressure of about fifty psi while the plastic resin is injected and cured. Although applicant is presently using thermosetting resin type 99213 produced by the Reichold Chemical Company of Tacoma, Wash. any suitable plastic could be used. The term plastic is used herein in its broadest sense, and includes, without limitation, thermoplastics and thermoset plastics, whether reinforced or unreinforced.

The fan is then allowed to cure within the mold for about 15 minutes, the mold having been preheated to a temperature of about 120 degrees Fahrenheit. The mold halves are parted and the fan is removed, after which the molded fan is deflashed around the perimeter.

From an inspection of FIGS. 18, 20, and 21 it will be seen that the mats 12, 16 and 18 are larger than the final fan 10, and so it is noted that the male and female molds are designed to produce a fan 10 which is larger than the final fan 10. This is done to ensure good distribution of the mats 12–18 in the final fan so the mats will extend fully to the edges of the final fan 10, for the best reinforcement thereof. After the fan is removed from the mold it is deflashed or trimmed to its final configuration by any suitable means such as with a jig and a band saw, the circular intersections 20 are formed with a one and one-half inch drill in a drill press, and the central hole 22 and six bold holes 24 are similarly drilled out to the desired size. All of the fans shown in FIGS. 1–30 are made in the forgoing way.

It has been found that the one piece fan so produced is about 50 percent stronger than a comparable fan which is assembled from similar materials, such as the fans shown in U.S. Pat. No. Des. 246,725 granted Dec. 20, 1977 to Bonifant. In addition, the one piece fan can be manufactured with about 10 percent less material cost and 25 prcent less labor. Finally, the one piece fan so produced is about 10 percent more efficient due to its smooth lines and lack of sharp edges and rivet heads such as found in said patent.

Figure 2:
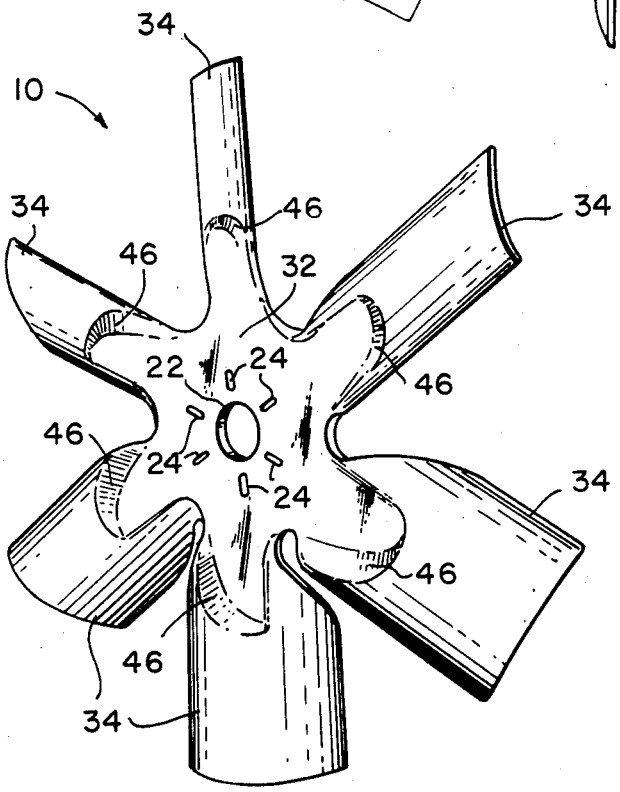
FIG. 2 is a perspective view of the front of the fan of the present invention which is identical to that shown in FIG. 1 except for its having a smaller central hole and correspondingly relocated mounting holes.

As seen in FIGS. 1 and 2, any of the fans shown in FIGS. 1–30 will accommodate a variety of sizes of central holes, a small central hole 22 being shown in FIG. 2 and a large inch central hole 26 shown in FIG. 1. Due to the unusual strength of the fan shown in FIGS. 1–30, the 8¾ inch hub shown therein by wy of example will accommodate a central hole up to at least about six inches in diameter.

The fans in FIGS. 1–30 can either be mounted with fasteners directly to an engine (not shown), or can be mounted to an engine's fan clutch 28 with fasteners 30. The fan clutch 28 forms no part of the present invention and operates in the usual fashion to disengage the fan 10 when the fan's cooling air flow through the engine's radiator (not shown) is not needed, and to engage the fan 10 when it is needed to provide cooling air.

The front (air receiving side) of the fan 10 is shown in FIG. 2 while its rear (air expelling side) is shown in FIG. 1. Similar terminology as to the front and rear of the fan 10 applies to all of the fans shown in FIGS. 1–30.

Figure 3:
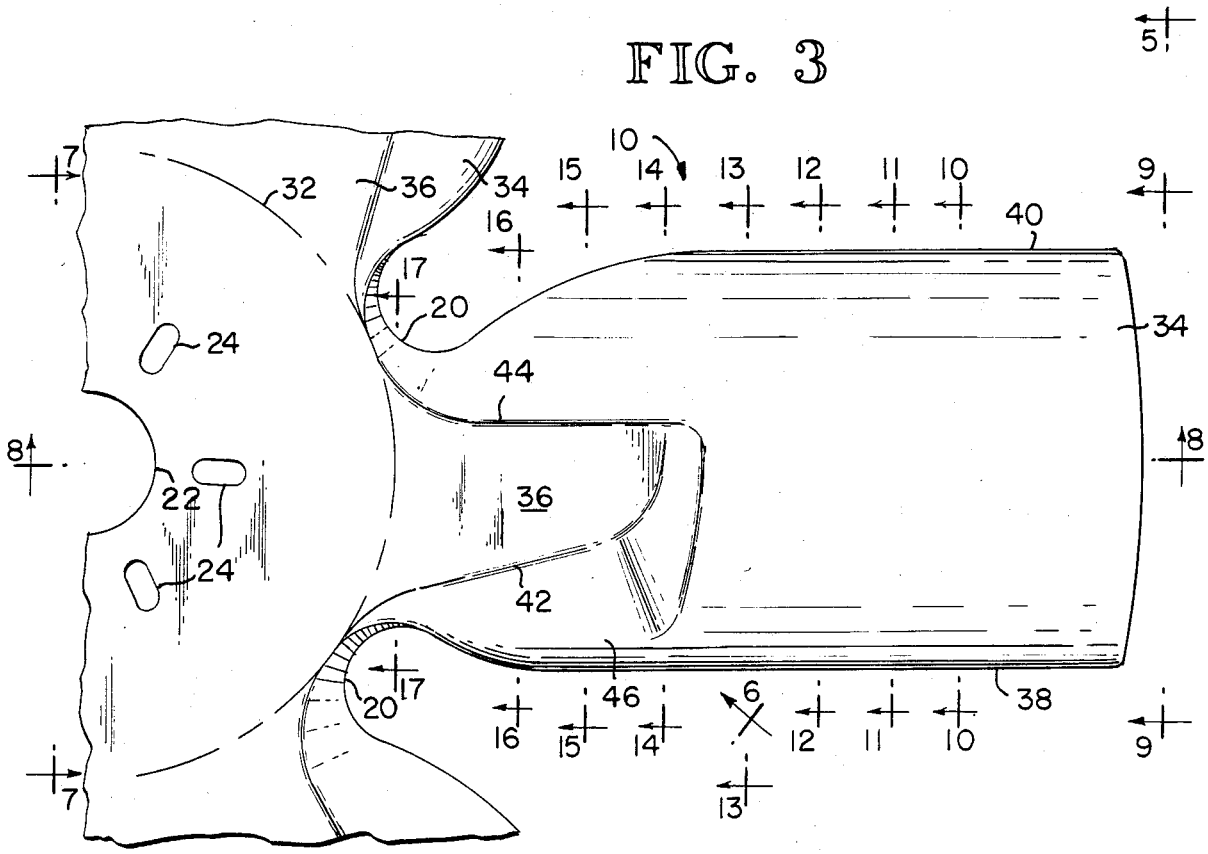
FIG. 3 is a front elevational view of the front of one portion of the fan shown in FIG. 2, on a ½ scale.
Figure 4:
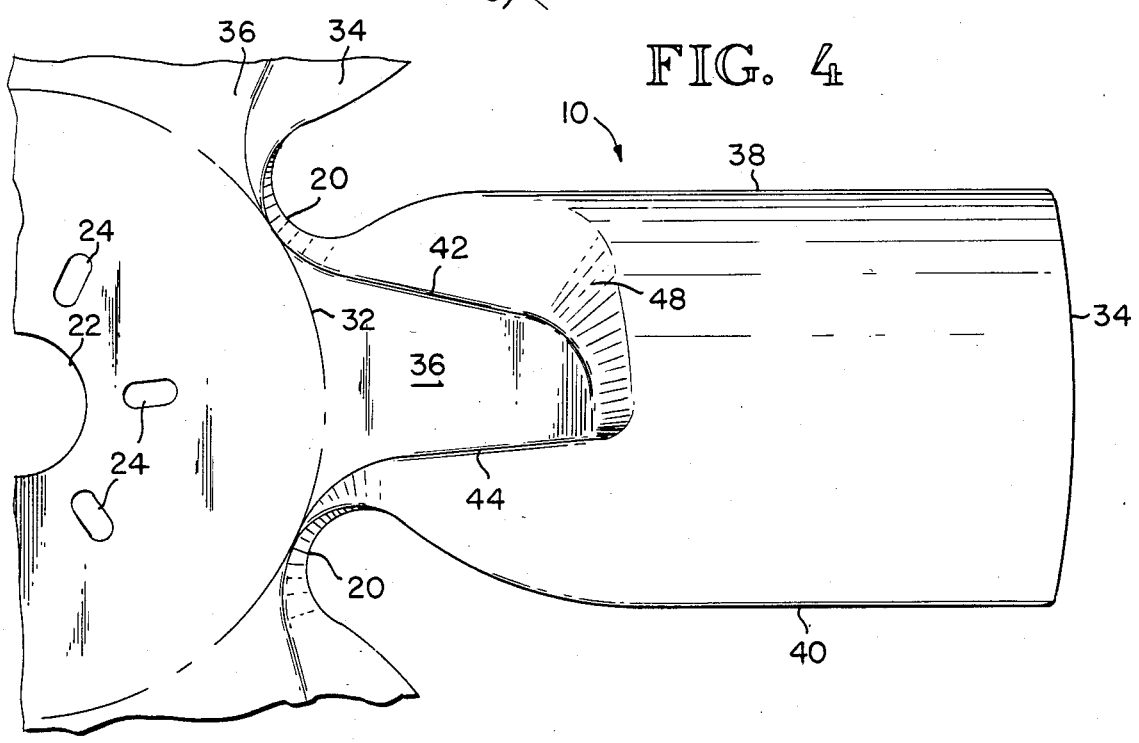
FIG. 4 is a rear elevational view of the rear of the fan shown in FIG. 3, on a ½ scale.

The fan 10 shown in FIGS. 1–21 comprises a hub 32 of uniform thickness shown in dotted outline in FIGS. 3 and 4. Extending outwardly into each blade 34 (six being shown by way of example) of the fan 10 is a hub extension 36 which is coplanar with the hub 32 and is of substantially the same strength or thickness. By way of example, the fan has an overall diameter of about 28 inches, the hub 32 is about 8¾ inches in diameter, the extensions 36 are about 3¼ inches long, and the blades 34, from hub 32 to their tips, are about 9½ inches long. The hole 22 is about 2 inches in diameter and intersection holes 20 are about 1½ inches in diameter. The hub 32 and extensions 34 are about ½ of an inch thick.

Figure 5:
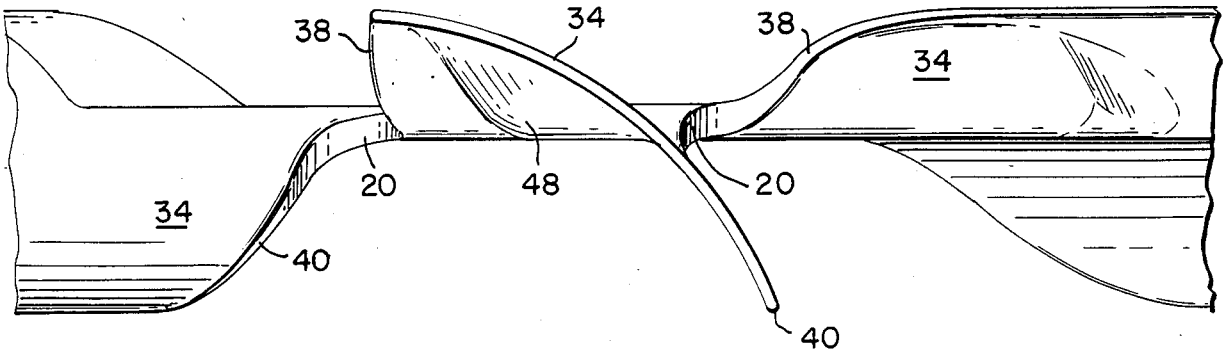
FIG. 5 is a side elevational view of the fan taken along line 5—5 of FIG. 3, on a ½ scale.
Figure 6:
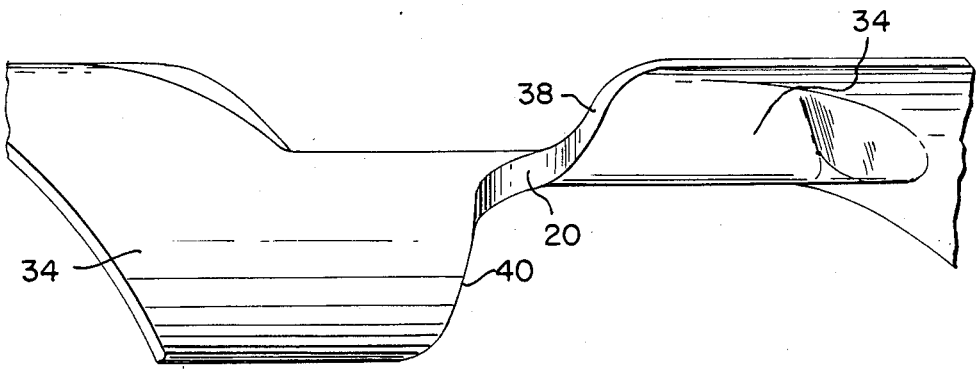
FIG. 6 is a side elevational view of the fan taken along sight line 6 of FIG. 3, on a ½ scale.
Figure 7:
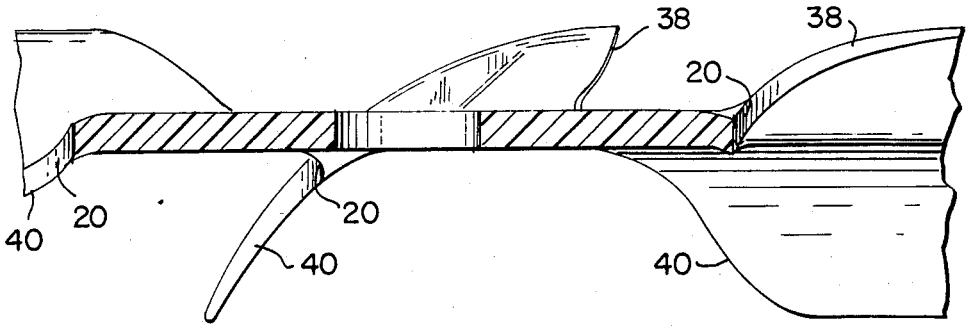
FIG. 7 is a cross sectional view of the fan taken along line 7—7 of FIG. 3, on a ½ scale.

As seen in FIGS. 3 and 4, note how the intersections 20 are located radially outwardly from the hub 32 so that the strength of the hub 32 is not diminished. In addition, as seen in FIGS. 5–7, note how the intersections 20 have a spiral configuration to help prevent stress concentrations, how the leading and trailing edges 38, 40 of the adjacent blades 34 merge into each other in a flowing arcuate line, how said leading and trailing edges 38, 40 are almost as thick as the hub adjacent to the hub intersection 20, and how the leading and trailing edges 38, 40 gradually taper in thickness radially outwardly from the hub. The intersections 20 which have a spiral configuration have a diameter of about 5 to 25 percent of the diameter of the hub 32.

Considering now the hub extensions 30, each hub extension has a length in the range of about 15 to 32 percent of the diameter of the fan 10, and a width at the hub 32 in the range of about 50 percent to 100 percent of the width of the blades 34 at the hub 32. The leading and trailing edges 42, 44 of each extension 36 join the hub 32 at substantially a tangent with respect thereto and merge directly into each other in a flowing, arcuate line to help to prevent undesireable stress concentrations. Each extension 36 forms a smoothly contoured depression 46 in the front of its blade 34 and a smoothly contoured protusion 48 in the rear of its blade 34.

The straight portion of the trailing edge 44 of each extension 36 lies on about the longitudinal centerline of its blade 34 and the leading edge 42 of each extension 36 extends generally diagonally from its intersection with the hub 32 to its intersection with the trailing edge 44 of the extension 36. The leading edge 42 of each extension 36 curves in its radially outermost portion to become generally perpendicular to its trailing edge 44 at its intersection therewith. Substantially greater than 50 percent of the intersection of each extension 36 with the hub 32 lies forwardly (towards the leading edge of the blade 34) of the longitudinal centerline of its blade 34.

As has been mentioned, each extension 36 forms a smoothly contoured depression 46 in the front of its blade 34 and a corresponding smoothly contoured protrusion 48 in the rear of its blade 34. The portions of the depression/protrusion 46, 48 between each extension 36 and the leading edge 38 of its blade 34 are substantially as thick as said extension adjacent to said extension, and gradually taper in thickness toward the leading edge 42 of its blade 34 (see FIGS. 14–17). As seen in FIGS. 1–4, those portions of each depression/protrusion lying radially outwardly from its extension 36 have a generally arcuate configuration and are thickened and straightened as compared to those portions of its blade 34 lying radially outwardly therefrom.

The portion of each blade 34 located between its extensions 36 and the blades trailing edge 40 are substantially as thick as said extension adjacent to said extension, and gradually taper in thickness towards the trailing edge 40 of its blade 34 (see FIGS. 14–17). Those portions of the blade located radially outwardly from the end of its extension 36 and its depression/protrusion 46, 48 are of substantially uniform thickness. However, each blade 34 does gradually taper in thickness in a direction radially outwardly from said hub 32 to the tip of said blade 34, and, in those portions of the blade 34 located radially outwardly from said hub extension 36 and depression/protrusion 46, 48. it tapers in thickness from its longitudinal centerline towards its leading and trailing edges 38, 40, being slightly thicker in its central longitudinal portion for increased stiffness (see FIGS. 8–17).

The pitch of each blade 34 with respect to the plane of the hub 32 gradually increases from about zero degrees at its leading edge 38 to about 60 degrees at its trailing edge 40.

Although the edges 38, 40 of the blades shown in the figures do not project equally above and below the plane of the hub 32, it is preferred that they do so, and this can be achieved by suitable trimming of their trailing edges 40, as with a band saw. It should be noted that the fan illustrated in the figures is designed so the tip portions of its blades, as well as their trailing edges, can be trimmed in order to achieve a fan with the desired air moving capacity for use in a particular vehicle. This is possible since in general the air moving capacity of any given fan design is proportional to the length of its blades and the projected height of its blades.

Turning now to FIGS. 22–24, 25–27 and 28–30, second, third and fourth forms of the present invention are illustrated, respectively. Each of these additional forms are identical to the forms shown in FIGS. 1–21 (except for the differences mentioned below) and similar parts have been given the same reference numerals throughout.

Turning now to the forms shown in FIGS. 22–28, each hub extension 50 is coplanar with the hub 32 at its intersection therewith, but now twists to become pitched substantially the same as its blade 34 a short distance radially outwardly from said hub 32. Otherwise, the extensions 50 are about the same as the extensions 32 of the fan of FIGS. 1–21. Of course, since the extensions 50 are twisted to become coplanar with the blades 34, the depression/protrusion 46, 48 of the fan shown in FIGS. 1–21 is no longer seen.

In the forms shown in FIGS. 25–27 and 28–30, each extension 52, 54, respectively, and its respective blade 34 is generally symmetrical about a common centerline extending radially outwardly from the center of the hub 32.

Referring now to the fan shown in FIGS. 25–27, it is seen that the extensions 52 are coplanar with the hub 32. Since the extensions 52 and their blades 34 are symmetrical about a common centerline, the single depression/-protrusion 46, 48 of the fan of FIGS. 1–21 is eliminated, and is replaced by a pair of smaller depression/protrusions 56, 58 and 60, 62.

Each element 56, 58 is located between its extension 52 and its blade 34's leading edge 38 and forms a depression 56 on the front of the blade and a protrusion 58 on the rear of the blade. Similarly, each element 60, 62 is located between its extension 52 and its blade 34's trailing edge 40 and form the depression 60 on the rear of the blade 34 and a protrusion 62 on the front of the blade. Other than the differences discussed above, the extensions 52 are about the same as the extensions 34 of the fan of FIGS. 1–21.

Referring now to the fan shown in FIGS. 28–30, each extension 54 is coplanar with the hub 32 but twists to become pitched substantially the same as its blade 34 a short distance radially outwardly from the hub 32. Other than all of these differences discussed above, the extensions 54 are about the same as the extensions 32 of the fan of FIGS. 1–21. Of course, since the extensions 54 are twisted to become coplanar with the blades 34, the depression/protrusion 46, 48 of the fan of FIGS. 1–21 is no longer seen.

From the forgoing, various further applications, modifications and adaptations of the fan disclosed by the forgoing preferred embodiments of the present invention will be apparent to those skilled in the art to which the present invention is addressed, within the scope of the following claims.

It is claimed:

1. A light weight, radiator cooling fan for vehicles, wherein the fan comprises:

a circular hub means of substantially uniform thickness, wherein its thickness is dictated by pertinent strength considerations;

a plurality of hub extension means; and one blade means for each hub extension means; wherein:

said hub means, said hub extension means, and said blade means are integrally formed from fiber reinforced plastic to make a one piece fan; and each said hub extension means has:

a thickness substantially equal to the thickness of said hub means;

a length substantially about the range of fifteen percent to thirty-two percent of the diameter of the fan; and a width at said hub means substantially about the range of fifty percent to one hundred percent of the width of said blade means at said hub means.

2. The fan, according to claim 1, wherein the leading and trailing edges of each said hub extension means joins said hub means at substantially a tangent with respect thereto help to prevent undesireable stress concentrations.

3. The fan, according to claim 1, wherein the leading and trailing edges of each pair of adjacent blade means merge directly into each other in a flowing, arcuate line to help to prevent undesireable stress concentrations.

4. The fan according to claim 1, wherein the leading and trailing edges of each pair of adjacent blade means merge at a location radially outwardly from said hub means.

5. The fan according to claim 1, wherein at the juncture area between each pair of adjacent blade means, the edges of said blade means follow a generally spiral path to help to prevent undesireable stress concentrations.

6. The fan according to claim 5, wherein the spiral has a diameter about five percent to twenty-five percent of the diameter of the hub means.

7. The fan according to claim 1, wherein the juncture area between each pair of adjacent blade means lies radially outwardly from said hub means, is substantially equal in thickness to said hub means, and is twisted out of the plane of said hub means, the portion of said juncture area formed by the trailing edge of a blade means being displaced toward one side of said hub means while the portion of said juncture area formed by the leading edge of the adjacent blade means is displaced toward the other side of said hub means.

8. The fan, according to claim 1, wherein each blade means is substantially uniform in thickness radially outwardly from its extension means, and has an area located radially outwardly from said hub means and between its hub extension and its trailing edge which is substantially stronger than those portions of said blade means which are substantially uniform in thickness, in order to help the trailing portion of said blade sustain the additive twist loads caused by centrifugal force and the aerodynamic loading of its said trailing portion.

9. The fan according to claim 1, wherein the pitch of each said blade means with respect to the plane of said hub means gradually increases from about zero degrees at its leading edge to about 60 degrees at its trailing edge.

10. The fan according to claim 1, wherein each said blade means gradually tapers in thickness in a direction radially outwardly from said hub means and said hub extension means; gradually tapers in thickness from said hub extension means towards the leading and trailing edges of said blade means; and is slightly thickened in its central longitudinal portion in those portions located radially outwardly from said extension means for increased stiffness.

11. The fan according to claim 1, wherein the portion of each blade means located radially outwardly from its extension means is of substantially uniform cross section, but is slightly thicker in its central longitudinal portion for increased stiffness.

12. The fan according to claim 1, wherein the leading and trailing edges of each said blade means project substantially equal distances above and below the plane of said hub means.

13. The fan according to claim 1, wherein each said hub extension means is substantially coplanar with said hub means and forms a generally smoothly contoured depression in the surface of one side of its blade means and a corresponding smoothly contoured protrusion in the surface of the opposite side of its blade means.

14. The fan according to claim 1, wherein each said hub extension is coplanar with said hub means at its intersection therewith, and twists to become pitched substantially the same as its blade means a short distance radially outwardly from said hub means.

15. The fan, according to claim 13, wherein each said hub extension and its respective blade means is generally symmetrical about a common centerline extending radially outwardly from the center of said hub means; and wherein each said hub extension forms a pair of generally smoothly contoured depressions in the surface of both sides of its blade means and a pair of corresponding smoothly contoured protrusions in the surface of the opposite both sides of its blade means.

16. The fan according to claim 14, wherein each said hub extension and its respective blade means is generally symmetrical about a common centerline extending radially outwardly from the center of said hub means.

17. The fan according to claims 13 or 15 wherein the trailing edge of each said extension means is substantially on the longitudinal centerline of its respective blade means.

18. The fan according to claim 17, wherein the leading edge of each said extension means extends generally diagonally from its intersection with said hub means to its intersection with the trailing edge of said hub extension means.

19. The fan according to claim 18, wherein said leading edge of each hub extension means curves in its radially outermost portion to become generally perpendicular to said trailing edge of the hub extension means at its intersection therewith.

20. The fan according to claim 17, wherein substantially greater than 50 percent of the intersection of each said blade means and its associated hub extension means with said hub means lies on the leading edge side of the longitudinal centerline of said blade means.

21. The fan according to claim 17, wherein those portions of each said depression/protuberance lying radially outwardly from said hub extension means have an arcuate configuration and are strengthened as compared to those portions of said blade means lying radially outwardly therefrom, to help the blade withstand stress concentrations located at the radially outwardly end of the hub extension means.

* * * * *